US009912067B2

(12) United States Patent
Alu et al.

(10) Patent No.: US 9,912,067 B2
(45) Date of Patent: Mar. 6, 2018

(54) ELIMINATING RECIPROCITY CONSTRAINTS IN RADIATING AND SCATTERING SYSTEMS WITH SPATIO TEMPORAL MODULATION

(71) Applicant: Board of Regents, The University of Texas System, Austin, TX (US)

(72) Inventors: Andrea Alu, Austin, TX (US); Yakir Hadad, Austin, TX (US); Jason Christopher Soric, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 15/212,023

(22) Filed: Jul. 15, 2016

(65) Prior Publication Data

US 2017/0237175 A1 Aug. 17, 2017

Related U.S. Application Data

(60) Provisional application No. 62/213,921, filed on Sep. 3, 2015.

(51) Int. Cl.
*H01Q 13/10* (2006.01)
*H01P 3/00* (2006.01)
*H01Q 21/00* (2006.01)

(52) U.S. Cl.
CPC ..... *H01Q 13/10* (2013.01); *H01P 3/003* (2013.01); *H01Q 21/0006* (2013.01)

(58) Field of Classification Search
CPC ..... H01Q 13/10; H01Q 21/0006
(Continued)

(56) References Cited

U.S. PATENT DOCUMENTS

2007/0019754 A1 1/2007 Raleigh et al.
2007/0140374 A1 6/2007 Raleigh et al.
(Continued)

OTHER PUBLICATIONS

Hadad et al., "Space-Time Gradient Metasurfaces," Physical Review B, Rapid Communications, vol. 92, 100304, 2015, pp. 1-6.
(Continued)

*Primary Examiner* — Andrea Lindgren Baltzell
(74) *Attorney, Agent, or Firm* — Robert A. Voigt, Jr.; Winstead, P.C.

(57) ABSTRACT

A non-reciprocal device using a space-time modulation scheme. By applying the space-time modulation scheme, reciprocity in radiation and scattering scenarios is prevented. Such a scheme utilizes a linear system with simple, compact and inexpensive electronic components compared to the current use of bulky duplexers and non-reciprocal magnet based phase shifters to provide non-reciprocity. One such linear system involves traveling-wave antennas loaded with voltage dependent capacitors that are modulated in space and time thereby allowing the antenna to transmit with high directivity in a certain direction and not receive from that direction. Another linear system involves a resonant metasurface characterized by transverse spatiotemporal gradients, where the spatiotemporal gradients include periodically modulated impedances thereby causing a non-reciprocal transmission response. In this manner, a signal that propagates and impinges on the surface at a given direction will be fully transmitted while a signal propagating from the complementary direction will be fully reflected.

12 Claims, 14 Drawing Sheets

(58) Field of Classification Search
USPC ..... 343/771
See application file for complete search history.

(56) References Cited

U.S. PATENT DOCUMENTS

2013/0208823 A1 8/2013 Raleigh et al.
2015/0030280 A1* 1/2015 Alu ..... G02F 1/0136 385/2

OTHER PUBLICATIONS

Kodera et al., "Integrated Leaky-Wave Antenna-Duplexer/Diplexer Using CRLH Uniform Ferrite-Loaded Open Waveguide," IEEE Transactions on Antennas and Propagation, vol. 58, No. 8, Aug. 2010, pp. 2508-2514.
Azad et al., "Direct Antenna Modulation (DAM) for Enhanced Capacity Performance of Near-Field Communication (NFC) Link," IEEE Transactions on Circuits and Systems—I: Regular Papers, vol. 61, No. 3, Mar. 2014, pp. 902-910.
Qin et al., "Nonreciprocal Components with Distributedly Modulated Capacitors," IEEE Transactions on Microwave Theory and Techniques, vol. 62, No. 10, Oct. 2014, pp. 2260-2272.
Hadad et al., "Non-Reciprocal Space-Time Gratings," 2015 IEEE International Symposium on Antennas and Propagation and North American Radio Science Meeting, Jul. 19-24, 2015, Vancouver, British Columbia, Canada, poster, one page.
Hadad et al., "Spatiotemporally Modulated Antennas," 2015 IEEE International Symposium on Antennas and Propagation and North American Radio Science Meeting, Jul. 19-24, 2015, Vancouver, British Columbia, Canada, poster, one page.
Kejie Fang, "Controlling the Flow of Light Using the Inhomogeneous Effective Gauge Field that Emerges from Dynamic Modulation," Physical Review Letters, vol. 111, 203901, Nov. 15, 2013, pp. 1-5.
Sounas et al., "Giant Non-Reciprocity at the Subwavelength Scale Using Angular Momentum-Biased Metamaterials," Nature Communications, 10.1038, Sep. 2, 2013, pp. 1-7.
Yu et al., "Complete Optical Isolation Created by Indirect Interband Photonic Transitions," Nature Photonics, vol. 3, 10.1038, Feb. 2009, pp. 91-94.
Hadad et al., "One Way Optical Waveguides for Matched Non-Reciprocal Nanoantennas with Dynamic Beam Scanning Functionality," Optics Express A78, vol. 21, No. S1, Jan. 14, 2013, pp. 1-7.
Sounas et al., "Angular-Momentum-Biased Nanorings to Realize Magnetic-Free Integrated Optical Isolation," ACS Photonics, vol. 1, 2014, pp. 198-204.
Lira et al., "Electrically Driven Nonreciprocity Induced by Interband Photonic Transition on a Silicon Chip," PHysical Review Letters, vol. 109, 033901, 2012, pp. 1-5.
Lin et al., "Light Guiding by Effective Gauge Field for Photons," Physical Review X, vol. 4, 031031, 2014, pp. 1-8.
Hadad et al., "Breaking Temporal Symmetries for Emission and Absorption," PNAS, vol. 113, No. 13, Mar. 29, 2016, pp. 3471-3475.
Fleury et al., "Sound Isolation and Giant Linear Nonreciprocity in a Compact Acoustic Circulator," Science, vol. 343, Jan. 31, 2014, pp. 516-519.

* cited by examiner

ELIMINATING RECIPROCITY CONSTRAINTS IN RADIATING AND SCATTERING SYSTEMS WITH SPATIO TEMPORAL MODULATION

GOVERNMENT INTERESTS

This invention was made with government support under Grant No. FA9550-13-1-0204 awarded by the Air Force Office of Scientific Research and Grant No. HDTRA1-12-1-0022 awarded by the Department of Defense/Department of Threat Reduction. The U.S. government has certain rights in the invention.

TECHNICAL FIELD

The present invention relates generally to reciprocity and time-reversal symmetry, and more particularly to eliminating reciprocity constraints in radiating and scattering systems, such as antennas, metasurfaces or frequency selective surfaces by using space-time modulation of the structure.

BACKGROUND

Typical non-magnetic radiators or scatterers obey reciprocity and will exhibit a time symmetric response. For example, radiation patterns of an antenna in transmit and receive modes will be identical. This presents challenges in complex environments in which a directive antenna is typically forced to listen to its reflected echo. In the context of energy harvesting, solar panels and thermophotovoltaic cells are tailored to be highly absorbing in the spectral range of interest, typically in the visible or infrared range. However, reciprocity and time-reversal symmetry fundamentally requires these highly absorbing structures to also be very good emitters in the same spectral range. This fundamental relationship implies that, as the panels heat up, they are required to emit a significant portion of absorbed energy in the form of thermal infrared emission towards the source, causing a reduction in efficiency. In another example, an incident wave upon a metasurface is scattered with some efficiency towards some direction, then a backward propagating wave from that direction will be equally coupled to a backward propagating wave towards the direction of original incidence thereby causing a reduction in efficiency.

Over the years, a few groups have pointed out that, by preventing reciprocity, one may be able to overcome these challenges. Reciprocity can be prevented by using magnetic materials, such as ferrites. However, such materials are bulky and made of expensive rare earth materials and require large magnetic field biasing. Alternatively, reciprocity can be prevented using non-linear materials. However, the use of non-linear materials results in undesirable signal distortion and a power dependent response.

As a result, there is not currently an effective means for eliminating the reciprocity constraints in radiating and scattering systems, such as antennas, metasurfaces or frequency selective surfaces.

SUMMARY

In one embodiment of the present invention, a non-reciprocal device comprises a transmission line comprising a plurality of radiation aperture slots, where the transmission line is periodically loaded with voltage dependent circuit elements and where the plurality of radiation aperture slots function as an antenna coupled to the transmission line.

Furthermore, a modulation signal propagates along the transmission line and modulates the antenna in space and time by varying the voltage dependent circuit elements thereby yielding a non-reciprocal radiation response.

In another embodiment of the present invention, a non-reciprocal device comprises a resonant metasurface characterized by transverse spatiotemporal gradients, where the spatiotemporal gradients comprise periodically modulated impedances in space and time thereby causing a non-reciprocal transmission response.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE DRAWINGS

A better understanding of the present invention can be obtained when the following detailed description is considered in conjunction with the following drawings, in which.

DETAILED DESCRIPTION

Thermal management and heat control is a science with a long tradition in many engineering contexts, and over the years it has become of fundamental importance to address growing challenges related to heat dissipation. In the context of energy harvesting, solar panels and thermophotovoltaic cells are tailored to be highly absorbing in the spectral range of interest, typically in the visible or infrared range. However, reciprocity and time-reversal symmetry fundamentally require these highly absorbing structures to also be very good emitters in the same spectral range. This fundamental relationship implies that, as the panels heat up, they are required to emit a significant portion of absorbed energy in the form of thermal infrared emission towards the source, causing a reduction in efficiency. Similarly, relevant challenges are present in heat dissipation and thermal management in other engineering contexts, connected with fundamental reciprocity limitations. Reciprocity poses also severe restrictions in radio-communications: wireless systems and antennas are bound by reciprocity to transmit and receive in the same direction, i.e., the transmission and reception gain patterns $G_{TX}(\theta),G_{RX}(\theta)$ of an antenna are identical. This presents challenges in complex environments in which a directive antenna is typically forced to listen to its reflected echo.

Over the years, a few groups have pointed out that, by preventing reciprocity, one may be able to overcome these challenges. The most established route to prevent reciprocity is based on biasing ferromagnetic materials or ferrites with a magnetic field. This method requires the use of scarcely available materials, such as rare-earth metals, and bulky magnets, making them highly impractical. For instance, a nanoscale plasmonic non-reciprocal antenna was proposed, but its requirements on magnetic biasing make it largely impractical. Alternatively, reciprocity can be also broken with non-linearities; however, this leads to undesirable signal distortion and a power dependent response.

As discussed herein, the present invention allows structures that can emit without absorbing from the same direction. More specifically, as discussed herein, by simultaneously modulating an emitting structure in both space and time, it is possible to break reciprocity constraints in radiation, significantly altering the structure's absorptivity and emissivity patterns, and opening exciting possibilities in the areas of thermal management, energy harvesting, and radio-wave communications.

Figure 1A:
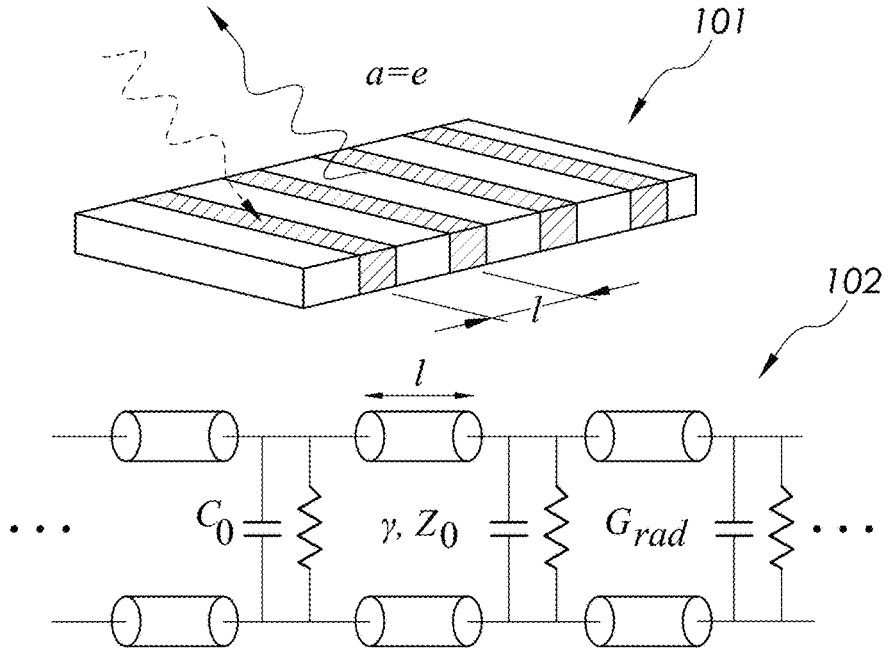
FIG. 1A illustrates a periodically loaded open waveguide and its equivalent circuit model in accordance with an embodiment of the present invention.

Consider first a conventional open waveguide, such as a dielectric slab supporting slow-wave propagation with wavenumber $\beta>k$. Since its dispersion is outside the light cone, when excited, the guided modes do not couple to free-space. Directional emission can be achieved when a periodic loading with periodicity l is introduced, as shown in the top of FIG. 1A. FIG. 1A illustrates a periodically loaded open waveguide 101 (top part of FIG. 1A) and its equivalent circuit model 102 (bottom part of FIG. 1A) in accordance with an embodiment of the present invention. As illustrated in FIG. 1, in one embodiment, equivalent circuit model 102 of the waveguide uses shunt capacitors $C_0$ as loads. The introduction of periodicity folds the modal dispersion in the $1^{st}$ Brillouin zone, as shown in FIG. 1B, and thus a portion enters into the light cone, associated with fast, radiating modes.

Figure 1B:
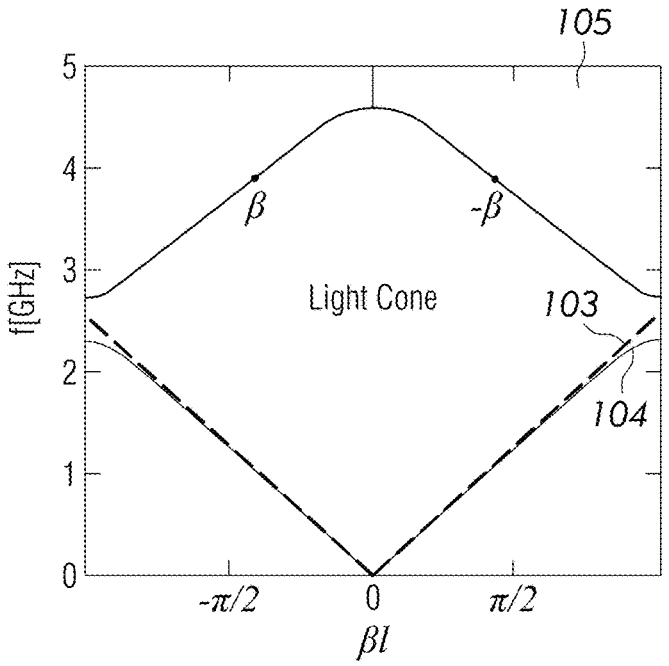
FIG. 1B illustrates the unloaded waveguide dispersion and the periodically loaded waveguide dispersion in accordance with an embodiment of the present invention.

FIG. 1B illustrates the unloaded waveguide dispersion 103 and the periodically loaded waveguide dispersion 104 in accordance with an embodiment of the present invention. Referring to FIG. 1B, the loaded waveguide dispersion 104 enters the light cone 105, enabling radiation. Yet, the structure is reciprocal with symmetric dispersion. In the corresponding circuit model, this radiation is modeled with a conductance $G_{rad}$ that depends on the frequency and wavenumber. Since the structure is reciprocal, the Brillouin dispersion is symmetric: emission and absorption at frequency $\omega$ take place through symmetric channels with wavenumbers $\beta(\omega)$ and $-\beta(\omega)$, yielding equal receiving and transmitting properties, in compliance with time-reversal symmetry. Similar constraints apply if one looks at the absorption properties of periodic structures at infrared frequencies, with their thermal emission pattern being governed by Planck's law.

Figure 1C:
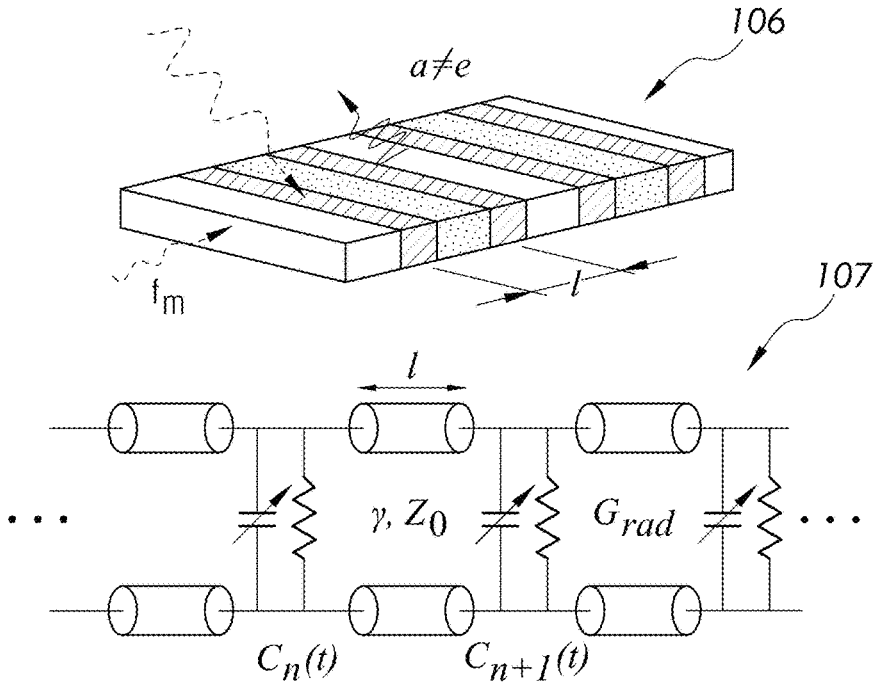
FIG. 1C illustrates that non-reciprocity is introduced by applying space-time modulation in accordance with an embodiment of the present invention.

This picture breaks down when the electric characteristics of the grating are modulated simultaneously in space and time, as illustrated in FIG. 1C. FIG. 1C illustrates that non-reciprocity is introduced by applying space-time modulation in accordance with an embodiment of the present invention. In particular, FIG. 1C illustrates the periodically loaded open waveguide 106 (top part of FIG. 1C) and its equivalent circuit model 107 (bottom part of FIG. 1C) when applying space-time modulation.

In the equivalent model 107, the capacitors are assumed to follow the temporal dispersion $C_n(t)=C_0+\Delta C\cos(\omega_m t-n\phi_m)$, where $\omega_m$ is the modulation frequency, and $\phi_m$ is the phase difference between successive capacitors. The calculated dispersion of the corresponding modulated structure is shown in FIG. 1D in accordance with an embodiment of the present invention.

Figure 1D:
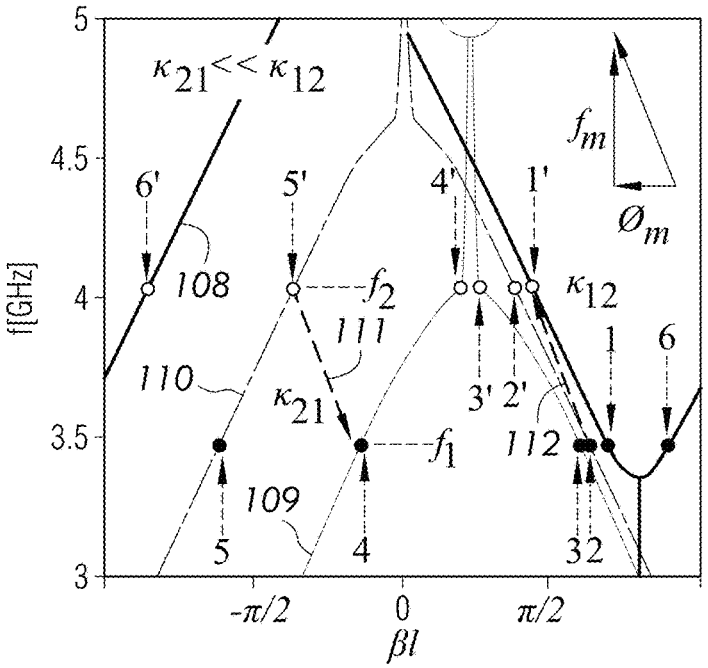
FIG. 1D illustrates the calculated dispersion of the corresponding modulated structure in accordance with an embodiment of the present invention.

As illustrated in FIG. 1D, the modulated structure dispersion is asymmetric, indicating non-reciprocity. The wave solutions represented by lines 108, 109 correspond to higher-order harmonics, replicas of the dispersion of the unmodulated structure (line 110) shifted in the first Brillouin zone. The coupling between harmonics, enabled by space-time modulation, is much stronger on the right side of the diagram.

To explain the result, it is assumed that the modulation amplitude is vanishingly small $\Delta C \rightarrow 0$. Then, applying Bloch theorem, it is possible to show that the dispersion consists of infinite replicas of the unmodulated dispersion bands, corresponding to space-time harmonics shifted by $\omega_m$ and $\phi_m$ along the frequency and wave number axes, respectively. Excitation at $\omega$ will in general allow coupling to other harmonics, based on frequency transitions $\omega \rightarrow \omega + n\omega_m$ with $n=0, \pm 1, \ldots$. Since it was assumed that $\Delta C \rightarrow 0$, these transitions are weak, and none of the higher-order harmonics is practically excited.

As the modulation amplitude $\Delta C$ grows, coupling between harmonics takes place, and the proximity between dispersion curves in FIG. 1D determines the coupling strength. Intraband transitions, marked by arrows 111, 112 in FIG. 1D, transfer energy from fundamental to higher-order Bloch harmonics, with higher efficiency if the coupling is stronger. Consider for instance the transitions 2→1' and 5'→4, occurring between same frequencies and opposite branches, as shown with arrows 111, 112. For the transition 2→1', on the right of the band diagram, excitation of the fundamental harmonic at frequency $f_1$ will result in upconversion of part of the energy to frequency $f_2$ (+1 harmonic), with large coupling strength $\kappa_{12}$. On the left of the band diagram, the transition 5'→4 downconverts an excitation at frequency $f_2$ to $f_1$ (−1 harmonic), but with weaker coupling strength $\kappa_{21} < \kappa_{12}$ because of the larger distance between branches.

Based on these asymmetric transitions enabled by space-time modulation, the concept of non-reciprocal emission at radio-frequencies (RF) has been demonstrated. A space-time modulated traveling-wave antenna has been used consistent with the circuit model in FIG. 1C, showing that it can provide largely asymmetric transmission and reception patterns. The antenna is based on a grounded coplanar waveguide with slotted apertures with period l=25.82 mm, designed to couple the guided wave into a radiation mode in the $f_{RF} \approx 3.6$-4.2 GHz frequency range, as shown in FIG. 2A.

Figure 2A:
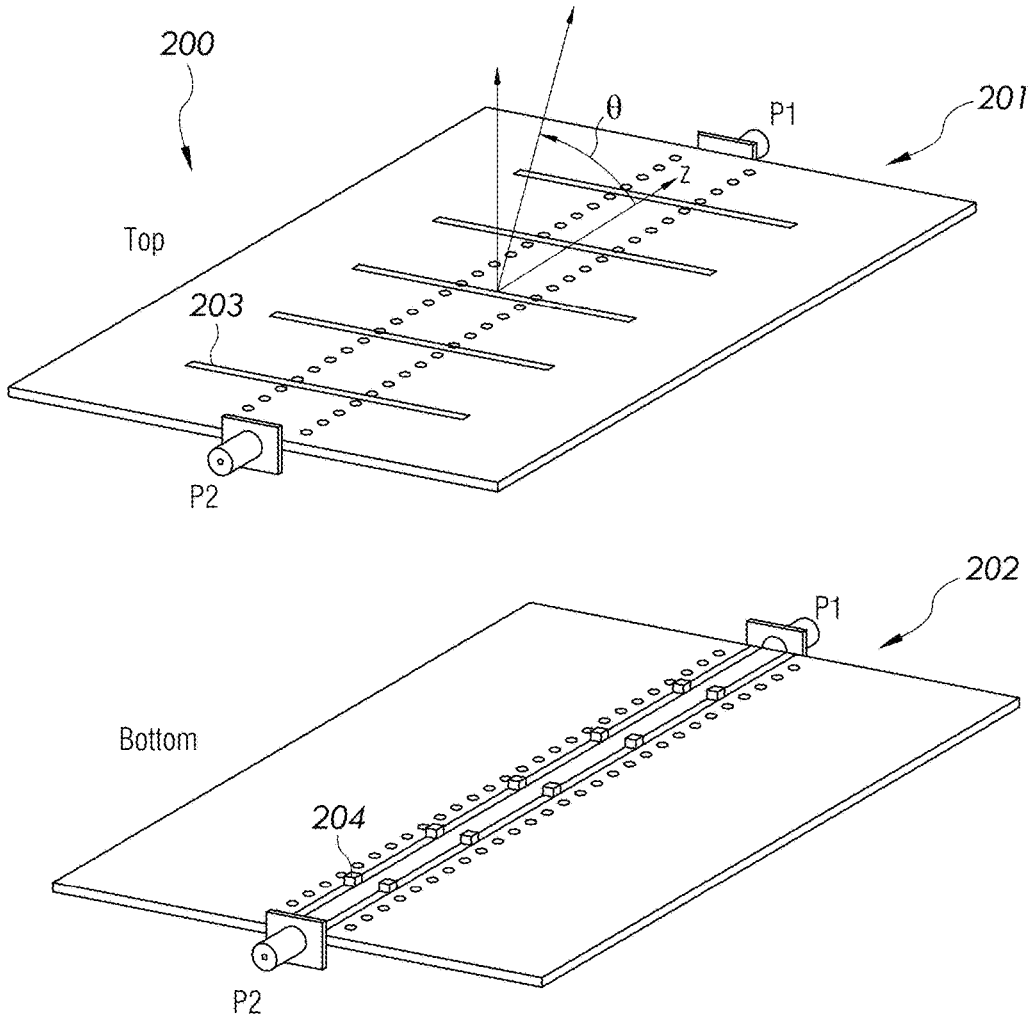
FIG. 2A illustrates a coplanar transmission line periodically interrupted to enable radiation in accordance with an embodiment of the present invention.

FIG. 2A illustrates a coplanar transmission line 200 periodically interrupted to enable radiation in accordance with an embodiment of the present invention. Referring to FIG. 2A, the coplanar transmission line 200 includes a top plane 201 and a bottom plane 202, where top plane 201 includes thin radiation aperture slots 203 and bottom plane 202 includes voltage dependent capacitors 204, located right below corresponding aperture slots 203 to control the propagation phase. In one embodiment, radiation aperture slots 203 function as an antenna coupled to transmission line 200. Furthermore, in one embodiment, voltage-tunable capacitors 204 enable space-time modulation. While FIG. 2A illustrates a coplanar transmission line 200, the principles of the present invention may be implemented using a composite right-handed/left-handed transmission line. An image of the fabricated structure together with its feeding network is shown in FIG. 2B in accordance with an embodiment of the present invention.

Figure 2B:
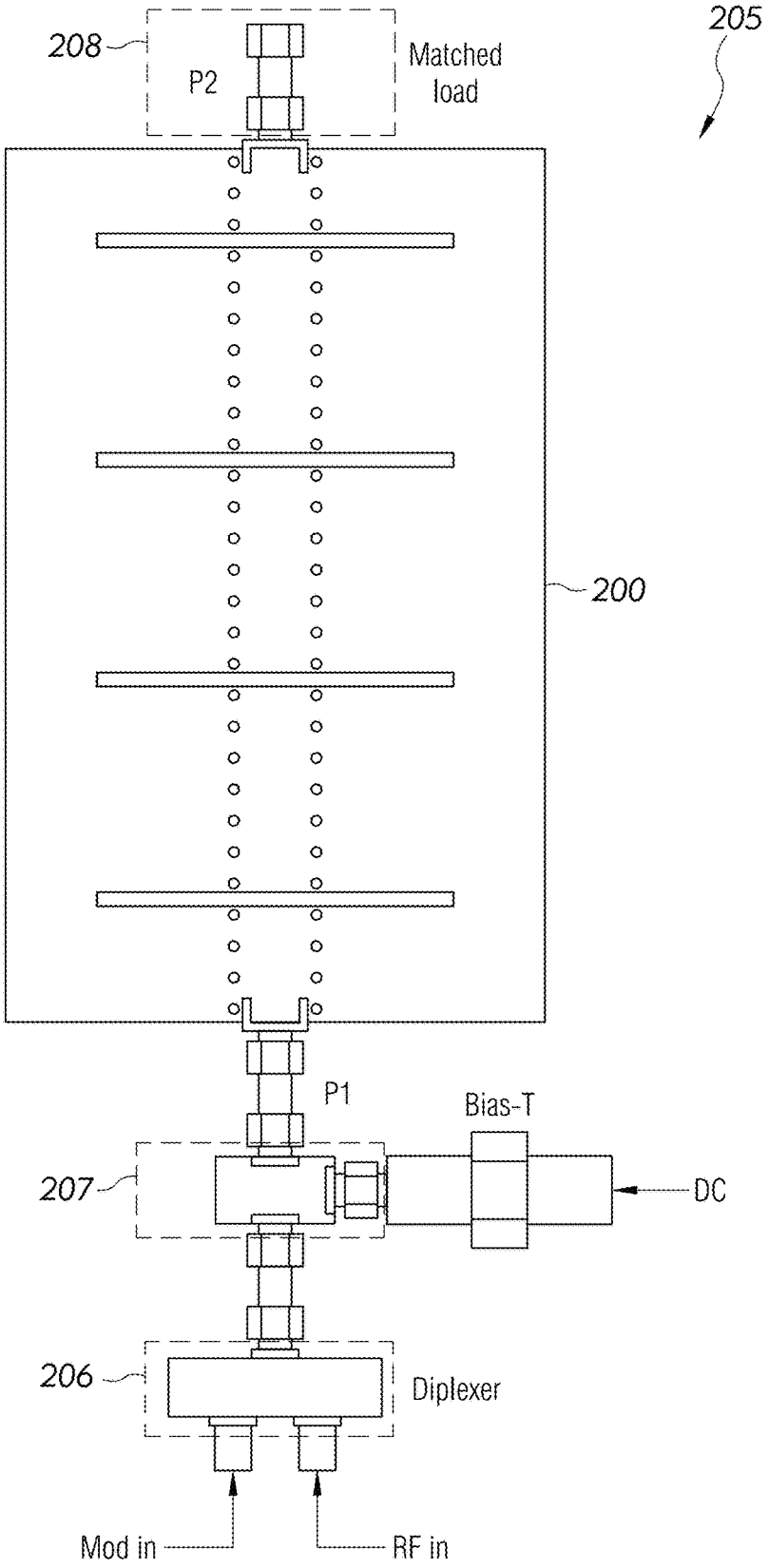
FIG. 2B illustrates an image of the fabricated structure of FIG. 2A and its feeding network in accordance with an embodiment of the present invention.

FIG. 2B illustrates an image 206 of the fabricated structure (fabrication of coplanar transmission line 200) and its feeding network, where the modulation control is achieved using a diplexer 206 that combines the radio-frequencies (RF) and modulation signals in a single port connected to coplanar transmission line 200 via a bias-tee 207 ("Bias-T") to superimpose the direct voltage bias. Coplanar transmission line 200 is connected to a matched load, such as antenna 208 (correspond to radiation aperture slots 203 which function as an antenna). A modulation signal propagates along coplanar transmission line 200 and modulates antenna 208 in space and time by varying voltage dependent capacitors 204 thereby yielding a non-reciprocal frequency conversion as discussed herein.

Figure 3A:
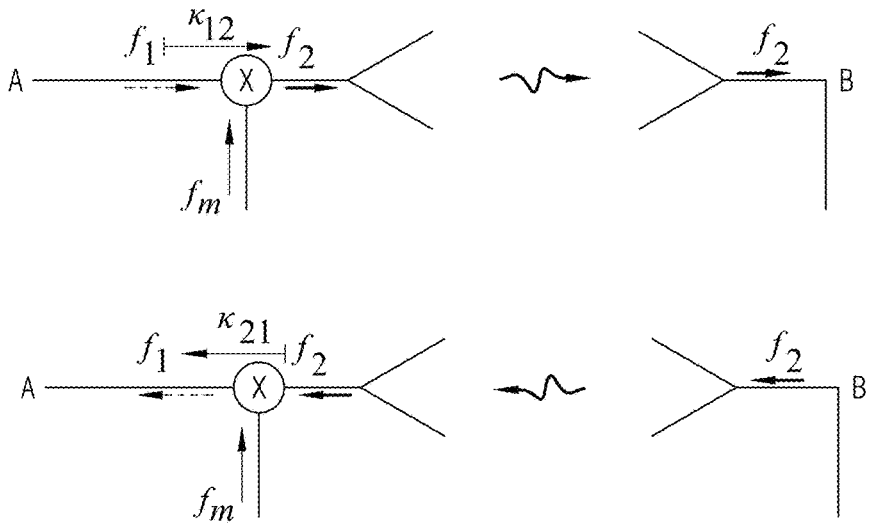
FIG. 3A illustrates the schematics of the frequency conversion and radiation system in accordance with an embodiment of the present invention.
Figure 3B:
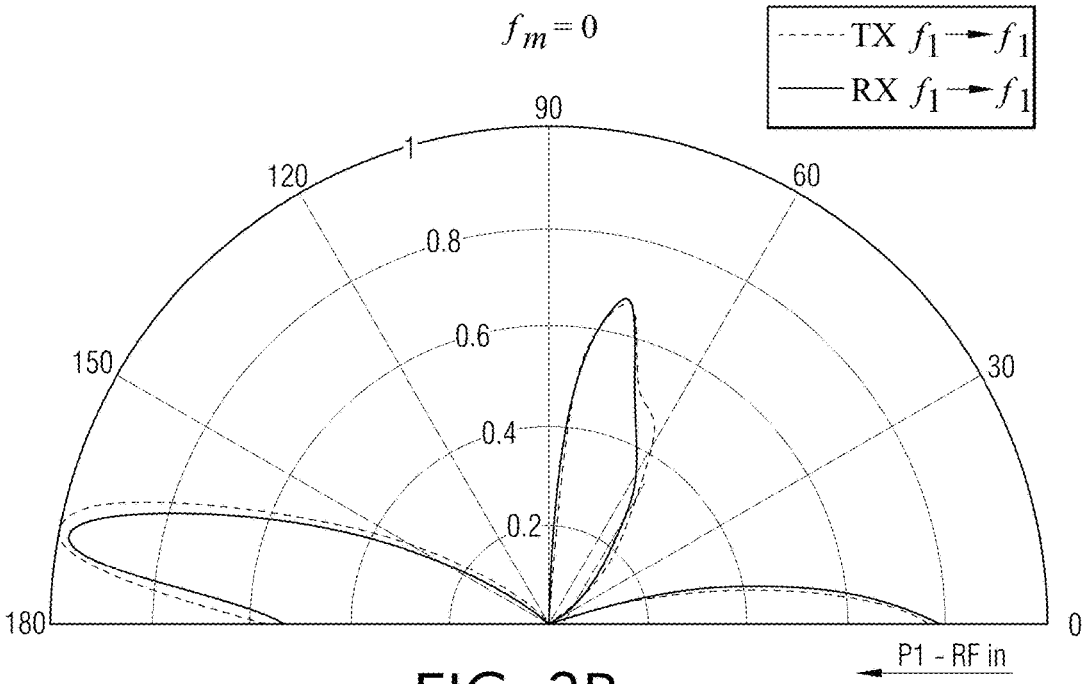
FIG. 3B illustrates the response without modulation, $\kappa_{12}=\kappa_{21}=0$ in accordance with an embodiment of the present invention.
Figure 3C:
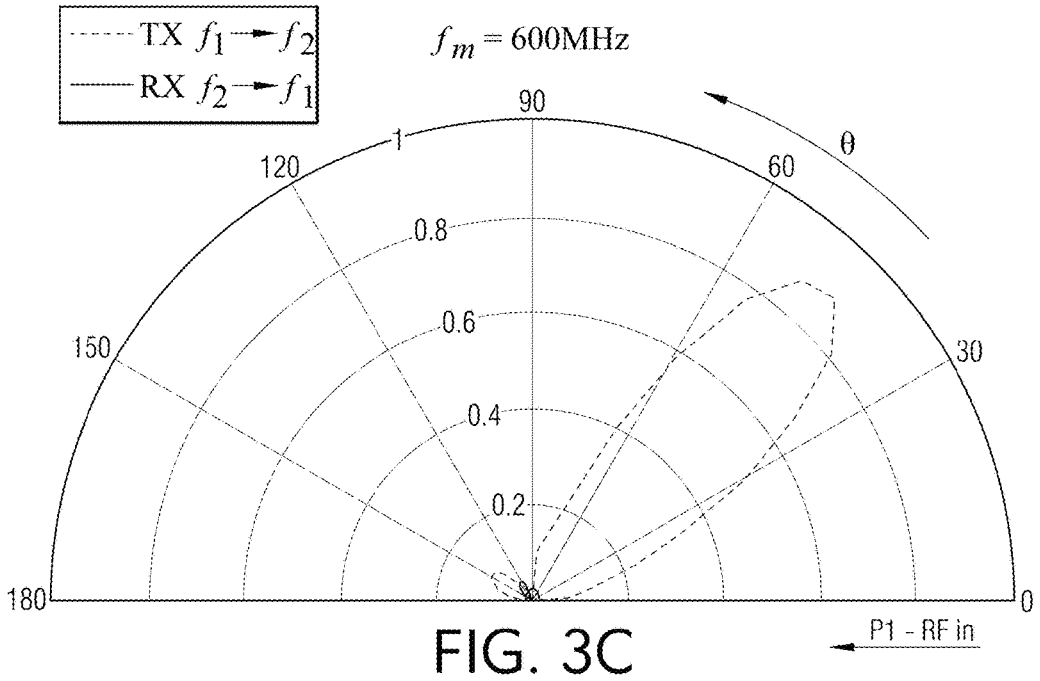
FIG. 3C illustrates the response with modulation, normalized with respect to the maximum in FIG. 3B in accordance with an embodiment of the present invention.

FIGS. 3A-3C illustrate the non-reciprocal radiation properties with frequency conversion based on the intraband transitions described in FIGS. 1A-1D. In particular, FIG. 3A illustrates the schematics of the frequency conversion and radiation system in accordance with an embodiment of the present invention. The top portion of FIG. 3A illustrates the transmit mode, whereas, the bottom portion of FIG. 3A illustrates the receive mode. The device is reciprocal if $\kappa_{12}=\kappa_{21}$, i.e., for a symmetric mixer. FIG. 3B illustrates the response without modulation, $\kappa_{12}=\kappa_{21}=0$, in accordance with an embodiment of the present invention. The antenna is reciprocal with identical RX and TX patterns. FIG. 3C illustrates the response with modulation, normalized with respect to the maximum in FIG. 3B, which reveals dramatic difference between transmit and receive operation, indicating strong non-reciprocity, in accordance with an embodiment of the present invention. A further discussion regarding FIGS. 3A-3C is provided below.

FIG. 3A is a diagram of a model of the system under analysis, with antenna A transmitting (top) and receiving (bottom), and antenna B receiving (top) and transmitting (bottom). Due to modulation, the left antenna may be described as fed through a mixer with mixing frequency $f_m=\omega_m/(2\pi)$. Frequency conversion takes place between frequencies $f_1$ and $f_2=f_1+f_m$ due to the intraband coupling shown by the arrows 111, 112 in FIG. 1D, with conversion coefficients denoted by $\kappa_{12}$ and $\kappa_{21}$. Different from a conventional mixer, the nonreciprocal nature of the system and the asymmetry in FIGS. 1A-1D requires the conversion coefficients to be different, opening to the possibility of highly non-reciprocal radiation properties, consistent with the previous discussion.

In the absence of dynamic modulation, only a static bias voltage (with no modulation signal) is applied to set the varying capacitors at their nominal operation point. The antenna is reciprocal with dispersion similar to FIG. 1B, and identical radiation patterns in transmission and reception, as shown in the measurements of FIG. 3B. However, this picture breaks down as a very weak modulation signal is injected at frequency $f_m$=600 MHz$\ll f_{RF}$ with amplitude such that $\Delta C/C_0 \approx 0.045$ through the Mod-in port in FIG. 2B. The modulation signal propagates along the transmission line and modulates the antenna in space and time, by varying the voltage dependent capacitors. Consequently, asymmetric transitions take place as in FIG. 1D, yielding non-reciprocal frequency conversion. Thanks to the carefully designed dispersion, this weak modulation is sufficient to largely break reciprocity.

FIG. 3C shows the measured radiation patterns in this modulated scenario in transmit and receive mode, with $f_1$=3.495 GHz, $f_2$=4.095 GHz. The transmit pattern radiates directively towards $\theta=50°$, as typical for a well-designed leaky-wave antenna, while the receive pattern is 17 dB lower. Referring to FIG. 3C, in conjunction with FIG. 1D, this large contrast is in agreement with FIG. 1D: in transmit operation we feed at point 2, and efficiently upconvert to the +1 harmonic $f_2$ at point 1', with $\beta_{1'}=k_2 \cos\theta=53.8\ m^{-1}$ ($k_2=2\pi f_2/c$). This transition was designed to efficiently couple energy from outside the light cone (point 2) to inside the light cone (point 1'). Therefore, despite the fact that typically the coupling coefficients $\kappa_{12}, \kappa_{21} \ll 1$ for weak modulation, radiation at the upconverted frequency is dominant. Even though the antenna used in this proof-of-concept experiment is relatively short, with an effective aperture of just ~1.22λ at frequency $f_1$, the peak gain in FIG. 3B is of similar magnitude as the gain in FIG. 3C after frequency conversion. With a longer antenna, the gain in FIG. 3C may be made significantly larger because of increased directivity. In receive operation, on the other hand, the incoming wave corresponds to point 5', which is weakly coupled to the −1 harmonic, leading to very poor reception. These results demonstrate that it is possible to have a basic radiating structure, made of conventional materials and modulated with a weak traveling signal, which efficiently emits a directive beam towards a specific direction, while it receives poorly from all directions, and thereby it is not sensitive to echoes from any angle.

Figure 4A:
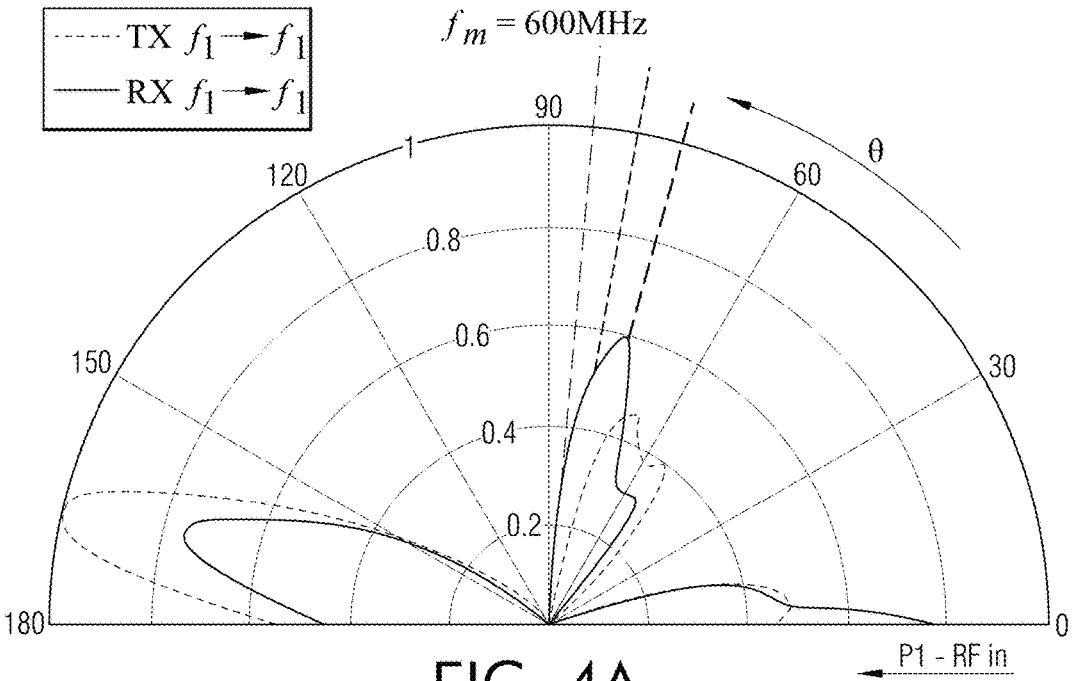
FIG. 4A illustrates the radiation pattern of the spatiotemporally modulated antenna at the feeding frequency in accordance with an embodiment of the present invention.
Figure 4B:
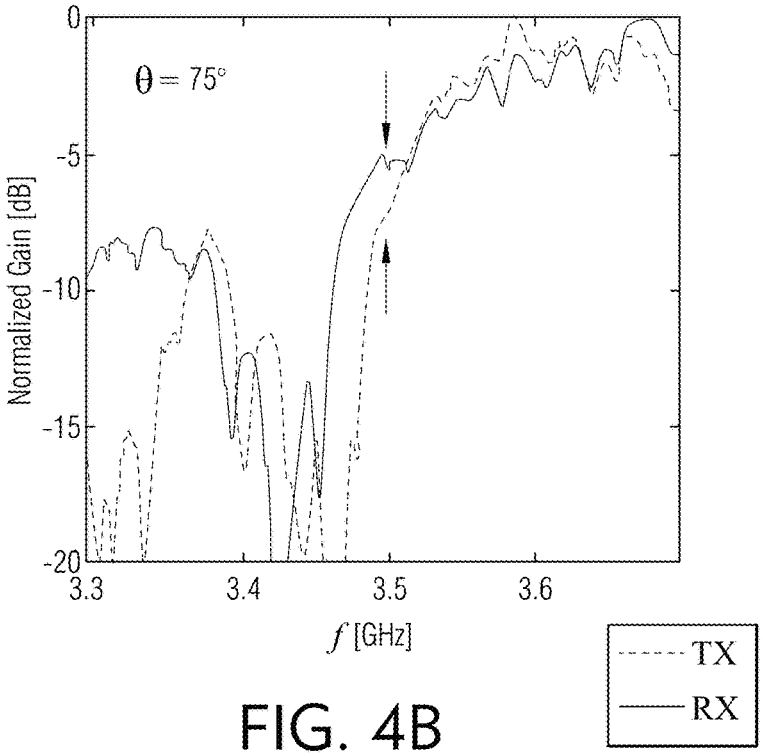
FIGS. 4B-4D illustrate the measured normalized gain spectra at $\theta=75°$, $80°$ and $85°$, respectively, in transmit and receive operation in accordance with an embodiment of the present invention.
Figure 4C:
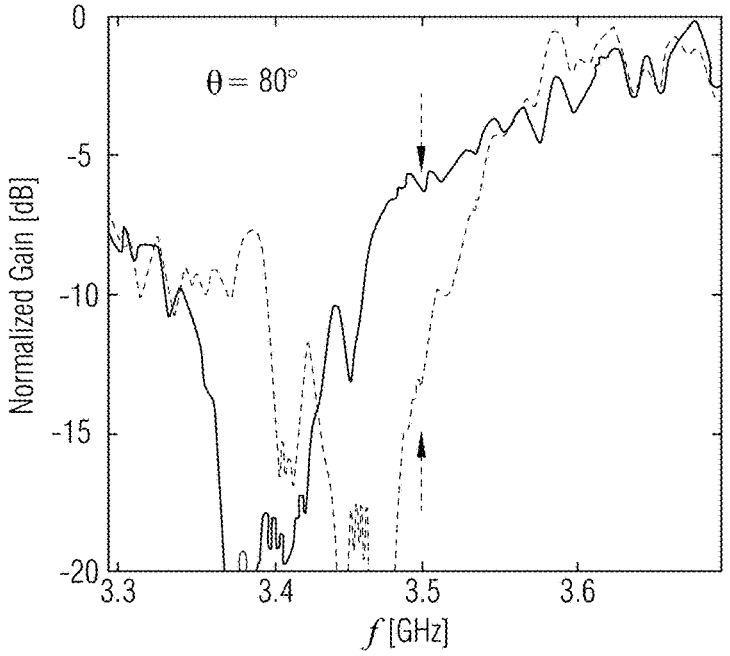
Figure 4D:
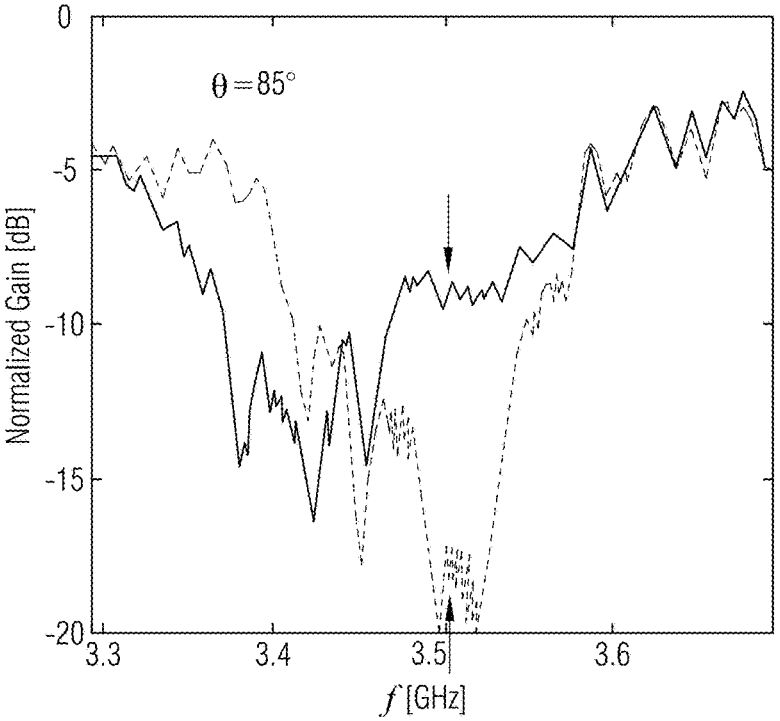

A direct consequence of the designed intraband transitions is also the generation of an asymmetry at the fundamental frequency, between forward (4, 5, 6) and backward (1, 2, 3) modes. This in turn ensures that the same structure is also non-reciprocal when analyzed at the fundamental frequency, without considering frequency conversion, as shown in FIGS. 4A-4D. FIG. 4A illustrates the radiation pattern of the spatiotemporally modulated antenna at the feeding frequency in accordance with an embodiment of the present invention. Signal reciprocity is prevented also at the fundamental frequency, leading to different patterns in transmit and receive. The most significant effect is seen around 60°-90°. FIGS. 4B-4D illustrate the measured normalized gain spectra at θ=75°, 80° and 85°, respectively, in transmit and receive operation, demonstrating a gain difference of about 15 dB (~30 fold) in accordance with an embodiment of the present invention. A further description of FIGS. 4A-4D is provided below.

In this regime, the designed antenna operates as a traveling wave, without supporting directive leaky radiation, consistent with the un-modulated radiation pattern shown in FIG. 3B. Once a weak modulation signal is injected at frequency $f_m$, the radiation patterns in transmit and receive modes are altered and become asymmetric, as seen in FIG. 4A. In this example, the major effect is observed in the angular range between θ=60° and θ=90°, where absorption (RX) and emission (TX) peak in different directions. The non-reciprocal response is stronger in the proximity of a sidelobe associated with higher spatial frequencies of the current distribution on the antenna, which are more affected by small perturbations associated with the weak modulation. In FIGS. 4B-4D, absorption and emission spectra for three different directions at θ=75°, 80° and 85°, respectively, are shown as a function of frequency. A significant (10-15 dB) difference is demonstrated over a reasonably broad frequency band. Absorption can be made much larger than emission, and vice-versa, and the reciprocity bound is clearly broken also at the same frequency. Large isolation is achieved with this design, especially around the nulls of radiation of the unmodulated case, which are shifted by the applied modulation. Better performance in this operation without frequency conversion is expected for more directive beamwidths, which may be achieved with a longer line, and using leaky-wave antennas that are based on the zero-th order diffraction, such as composite right-handed/left-handed transmission lines.

Hence, the principles of the present invention have enabled a device to have largely non-reciprocal emission/absorption properties, based on space-time modulation of a radiation aperture. It has been shown that it is possible to overcome common yet stringent limitations in radiating/emitting systems with direct applications in compact and efficient radio-frequency communication systems as well as energy harvesting and thermal management when translated to infrared frequencies. Furthermore, in one embodiment, the use of PIN junctions, acousto-optic or nonlinearity-based modulation may be utilized to realize these concepts at infrared/optical frequencies. The results discussed herein also show that time-varying emitters and antennas may provide a fertile ground for future communication systems.

Furthermore, using the principles of the present invention, metasurfaces may exhibit a non-reciprocal transmission response as discussed below. That is, a signal that propagates and impinges on the surface at a given direction will be fully transmitted while a signal propagating from the complementary direction will be fully reflected.

Snell's law of reflection and refraction describes the fact that at the interface between two homogeneous media the wave momentum is conserved. Transversely inhomogeneous frequency-selective surfaces at radio-frequencies and gradient optical metasurfaces have been recently proposed to bypass the conventional form of Snell's law by introducing clever transverse spatial modulations that can add an abrupt additional momentum discontinuity to the incident wave, yielding unusual scattering responses and "generalized refraction laws" over a surface. While these concepts have opened a plethora of interesting possibilities for physicists and engineers, allowing manipulation of light over a thin surface, there are fundamental constraints that a gradient metasurface cannot overcome. For instance, a thin electric surface is inherently limited in the amount of energy that it can couple into an anomalously refracted beam due to geometrical symmetries, requiring the use of thicker geometries or stacks.

Figure 5A:
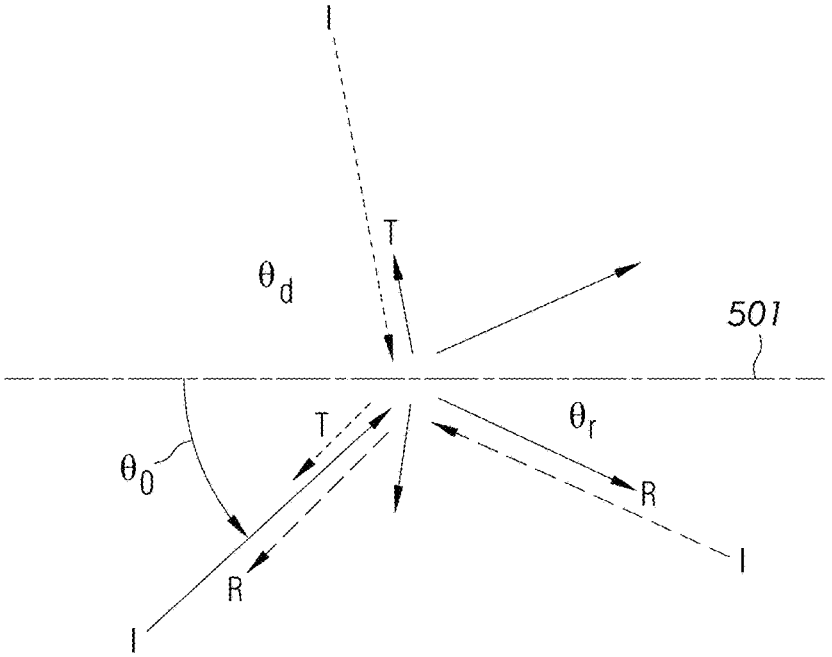
FIG. 5A illustrates the reciprocity constraints of a reciprocal surface with spatial gradients in accordance with an embodiment of the present invention.

Another fundamental constraint that gradient metasurfaces have to comply with is associated with reciprocity and time-reversal symmetry, $$R_{ii}(\theta_2,\theta_1)=R_{ii}(\theta_1,\theta_2),T_{ji}(\theta_2,\theta_1)=T_{ij}(\theta_1,\theta_2), \quad (1)$$

where $R_{ii}(\theta_2,\theta_1)$ and $T_{ji}(\theta_2,\theta_1)$ are the reflection (transmission) coefficient for a plane wave impinging on a surface from the i-th region with angle $\theta_1$ to a plane wave that is reflected (transmitted) to i-th (j-th) region, with angle $\theta_2$ (FIG. 5A). Eq. (1) states that, if one is able to transmit energy through a surface at a particular angle and refract or reflect it towards a specific direction, a plane wave with same transverse momentum coming back from that direction will couple as well to the original plane wave. These constraints may be overcome only by breaking time-reversal symmetry, which is possible using magneto-optical effects, nonlinearities or spatiotemporal modulation and moving media. Magneto-optical effects require bulky magnets and are difficulty accessible at optical frequencies, while nonlinearities are power dependent and require electrically large volumes. Furthermore, previously reported solutions for non-reciprocity have been typically limited to waveguide (closed) geometries, and do not allow full transmission, achieving isolation at the price of significant forward insertion loss. As discussed herein, it is possible to overcome the symmetry-related limitations of conventional spatially gradient metasurfaces by adding transverse temporal gradients. For the sake of clarity and mathematical tractability, the simplest gradient impedance surface—a periodically modulated impedance—is utilized. However, the results developed herein are extendable to any type of transverse gradients.

By combining the concept of temporal and spatial gradients in ultrathin metasurfaces, one can create an anomalous non-reciprocal electromagnetic induced transparency (EIT) effect. EIT was introduced in quantum optics as a technique to enhance nonlinear effects, while having strong transmission of the laser beam. Its potential applications are vast, as this mechanism allows slow group velocities that can spatially compress the impinging pulse shape and enhance light-matter interactions. Classical analogues of the EIT phenomenon, all reciprocal, have been studied in recent years to apply these unusual wave properties to optical devices and metamaterials. As discussed herein, a non-reciprocal EIT-like transmission window is realized through an ultrathin metasurface characterized by transverse spatiotemporal gradients, based on efficient light coupling that overcomes the constraints in Eq. (1). Interestingly, at the proposed EIT peak, the transmission amplitude can be made unitary, beyond the previously mentioned symmetry constraints of ultrathin surfaces, and at the same time largely non-reciprocal, yielding, in the absence of loss, an ideal free-space isolator without forward insertion loss.

To demonstrate the proposed concept, the transmission and reflection properties of a spatiotemporally modulated metasurface are considered lying on the x=0 plane, described by the time-dependent surface-impedance Lorentzian operator $$Z_s[i(z,t)]=\{L_0\partial_t i(z,t)+C_0^{-1}[1-m\cos(\beta z-\Omega t)]\int^t i(z,t)dt'\}, \quad (2)$$

which models a distributed series-network of inductors $L_0$ and spatiotemporally modulated capacitors $C(z,t)=C_0+\Delta C\cos(\beta z-\Omega t)$, and is applied to the surface current distribution $i(z,t)$. $\Omega$, $\beta$ are the temporal and spatial modulation frequencies. Eq. (2) holds under the assumption of weak modulation index, i.e., $m=\Delta C/C_0<<1$. Loss is neglected, which may be included by introducing a small series resistance. Furthermore, spatial dispersion effects are neglected assuming that the surface is composed of deeply subwavelength inclusions.

Figure 5B:
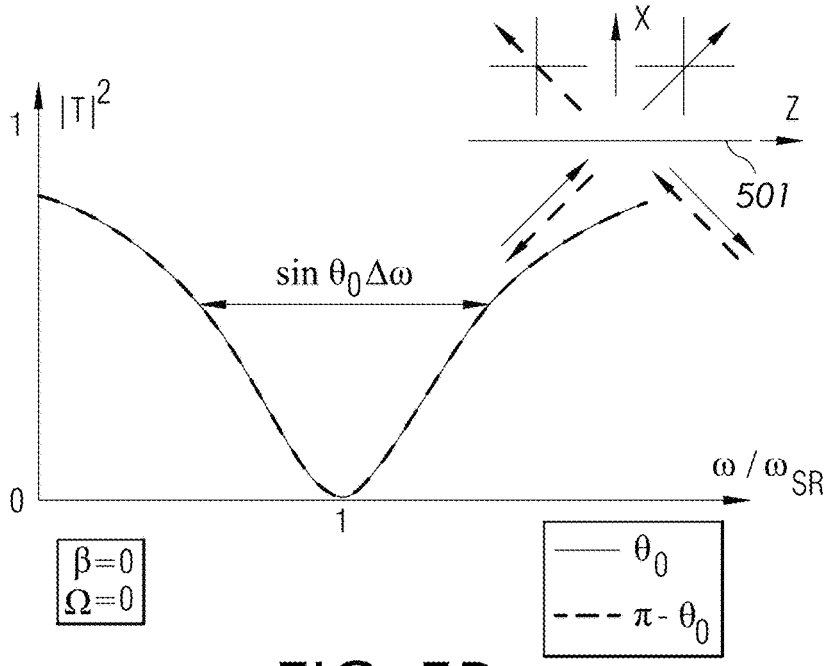
FIG. 5B illustrates the typical transmission through the surface impedance in Eq. (2) without modulation in accordance with an embodiment of the present invention.
Figure 5C:
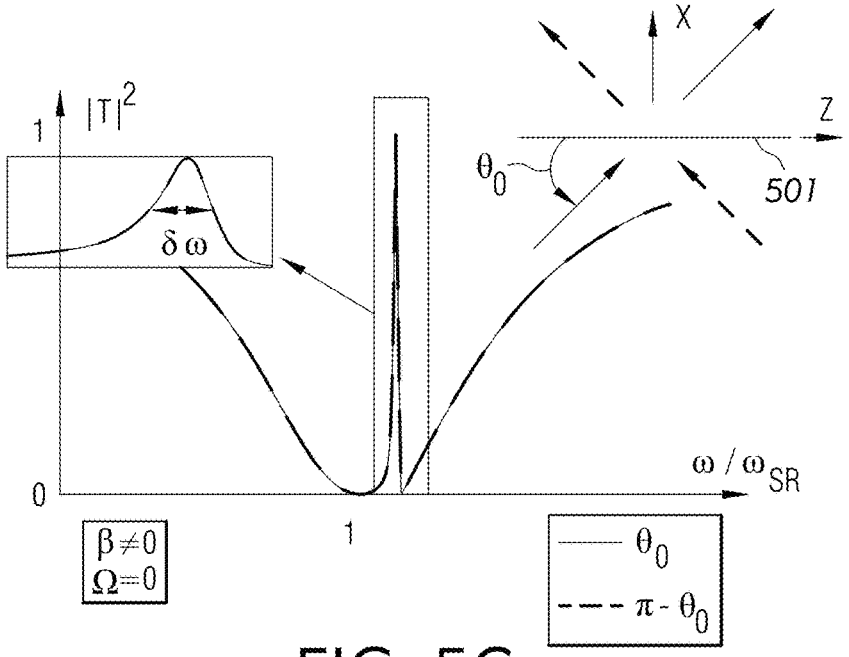
FIG. 5C illustrates that spatial modulation produces a reciprocal EIT-like transmission in accordance with an embodiment of the present invention.
Figure 5D:
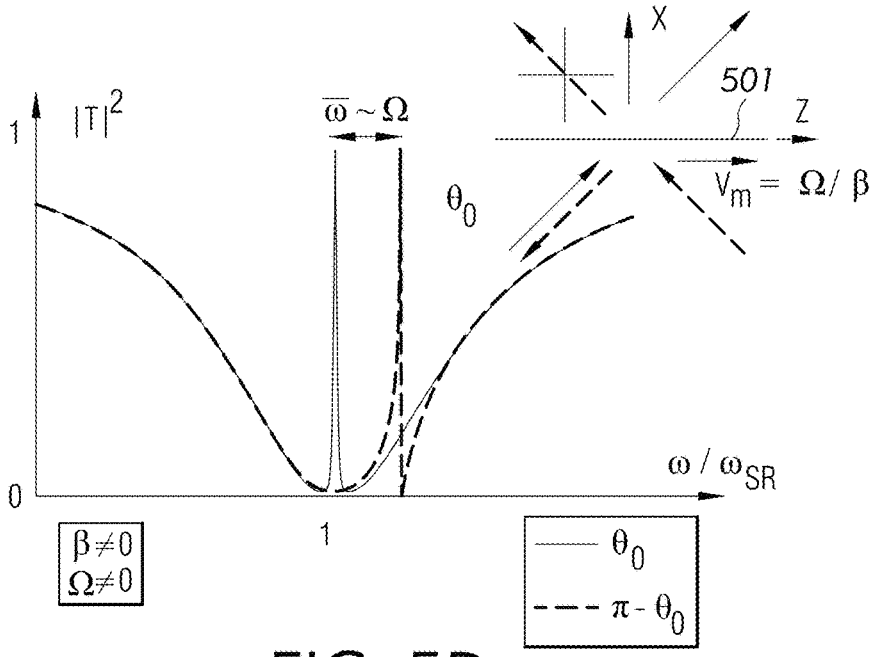
FIG. 5D illustrates that spatiotemporal modulation provides isolation in accordance with an embodiment of the present invention.

For the sake of brevity, transverse-magnetic (TM) excitation is only considered. The transverse-electric solution may be found similarly. The incident magnetic field is y-polarized with longitudinal wavenumber $k_z=k\cos\theta, k=\omega/c$ under an $e^{-\omega t}$ time convention. c is the speed of light. The angle $\theta$ is measured from the negative z axis, as shown in FIGS. 5A-5D. FIG. 5A illustrates the reciprocity constraints of a reciprocal surface with spatial gradients in accordance with an embodiment of the present invention. Line 501 represents the surface impedance. FIG. 5B illustrates the typical transmission through the surface impedance in Eq. (2) without modulation in accordance with an embodiment of the present invention. FIG. 5C illustrates that spatial modulation produces a reciprocal EIT-like transmission in accordance with an embodiment of the present invention. FIG. 5D illustrates that spatiotemporal modulation provides isolation in accordance with an embodiment of the present invention.

Referring to FIGS. 5A-5D, the reflected and transmitted fields do not need to comply with conventional Snell's law of refraction, due to the transverse gradients, and are generally written as infinite series of Floquet harmonics in both space and time:

$$\vec{H}^{t,r}=\hat{y}\sum_{n=-\infty}^{\infty}H_n^{t,r}e^{i(k_{z_n}z\pm k_{x_n}x-\omega_n t)}+c.c.$$

The superscripts t (r) denote transmitted (reflected) fields and correspond to the upper (lower) signs; $k_{x_n}=\sqrt{k_n^2-k_{z_n}^2}$ is the transverse wave number and, to satisfy the radiation condition, $\mathrm{Im}\{k_{x_n}\}\geq 0$. The radial frequency, wavenumber, and longitudinal wavenumber of the n-th harmonic are $\omega_n=\omega+n\Omega$, $k_n=\omega_n/c$, $k_{z_n}=k_z+n\beta$, respectively.

Due to the electric-field continuity across the metasurface, the zero-th order reflected and transmitted fields, which propagate at angles $\theta_r=\pi-\theta_i$ and $\theta_t=\theta_i$ respectively, are the strongest ones. However, this is not a fundamental constraint and it may be overcome by combining electric and magnetic metasurfaces, or stacking metasurfaces. The higher-order harmonics have different transverse momentum and frequencies than the incident wave. By enforcing the impedance boundary condition $Z_s\hat{x}\times[\vec{H}|_{x=0^+}-\vec{H}|_{x=0^-}]=\vec{E}_{tan}|_{x=0}$, one obtains $$A_nH_n^r-mZ_{c_{n+1}}H_{n+1}^r-mZ_{c_{n-1}}H_{n-1}^r=\delta_0H_0k_{x_n}/k_n, \quad (3)$$

where $H_n^t=H_n^r+H_0\delta_n$ and $\delta_n$ is the Kronecker delta, $A_n=(2Z_n+\eta_0k_{xn}/k_n)$, $Z_n=i\omega_nL_0+Z_{c_n}$ and $Z_{c_n}=1/i\omega_nC_0$. $Z_n$ and $Z_{c_n}$ are the metasurface and capacitor impedances associated with the n-th harmonic. Eq. (3) represents an infinite set of linear equations, which, in the case of weak modulation, may be truncated to the first three harmonics n=0,±1.

In the absence of modulation m=0, the impedance is zero at the surface resonance $\omega_{SR}=1\sqrt{L_0C_0}$ and the surface is fully reflective, as shown in FIG. 5B. When spatial modulation is introduced ($\beta\neq 0$), the surface becomes transparent in a narrow frequency band for a specified incidence direction, exhibiting an EIT-like transmission window, as shown in FIG. 5C, produced by the coupling of the broad surface resonance and a sharp grating resonance. Yet, in the absence of temporal modulation ($\Omega=0$), the response remains reciprocal and two full transmission peaks, corresponding to incidence angle $\theta_0$ and its complementary $\pi-\theta_0$, take place at the same frequency $\omega$, namely $T(\omega,\theta_0)=T(\omega,\pi-\theta_0)=1$. $T(\omega,\theta)$ corresponds to the 0-th order transmission. The metasurface symmetries require this response, in agreement with Eq. (1). Once a transverse temporal modulation at frequency $\Omega$ is considered, reciprocity breaks, and the two resonance peaks separate by $\overline{\omega}\sim\Omega$, as shown in FIG. 5D, creating the opportunity for large isolation. Interestingly, as shown below, the bandwidth of the EIT transmission peak $\delta\sigma\propto m^2$ decreases with the modulation index m. Counterintuitively, therefore, non-reciprocity is enhanced as m decreases. For a specified, arbitrarily small $\Omega$, in absence of losses, it is possible to find m resulting in large isolation.

To prove these properties, Eq. (3) is solved for the reflection coefficient $R=H_0^r/H_0$ $$R^{-1}=(k/\eta_0k_x)[A_0-m^2Z_{c0}Z_{c1}/A_1-m^2Z_{c0}Z_{c-1}/A_{-1}]. \quad (4)$$

Interestingly, full-transmission of the 0-th diffraction order and identically zero coupling to higher diffraction orders take place if $A_1=0$ or $A_1=0$. These conditions correspond to the resonant excitation of the 1,−1 diffraction order, and may be regarded as generalized anomalies for space-time gradient surfaces. The incident wave excites a leaky-wave resonance in the structure, which, by coupling with the spectrum of radiated modes, is able to cancel specular reflections and fully restore the incident power into the fundamental (0-th order) transmission angle. Consequently, a narrow transmission window is created within an angle-frequency region for which the unmodulated surface would be opaque. Depending on whether the leaky-wave resonance coincides with the resonance of the non-modulated surface or not, the transmission window has a symmetrical EIT-like or an asymmetrical Fano-like line-shape, as seen in FIGS. 5C and 5D. The resonance quality factor, denoted by $Q_{FT}$, is proportional to the leaky mode decay rate, and in order to have full-transmission, transverse momentum matching is essential between the incident wave and the leaky mode, i.e., $k \cos \theta_0 = \mathrm{Re}\{k_z^L\}$. $k_z^L$ is the leaky mode longitudinal wavenumber. Remarkably, the full transmission property is an exact result of Eq. (3), and not an artifact of the weak modulation approximation.

Figure 6A:
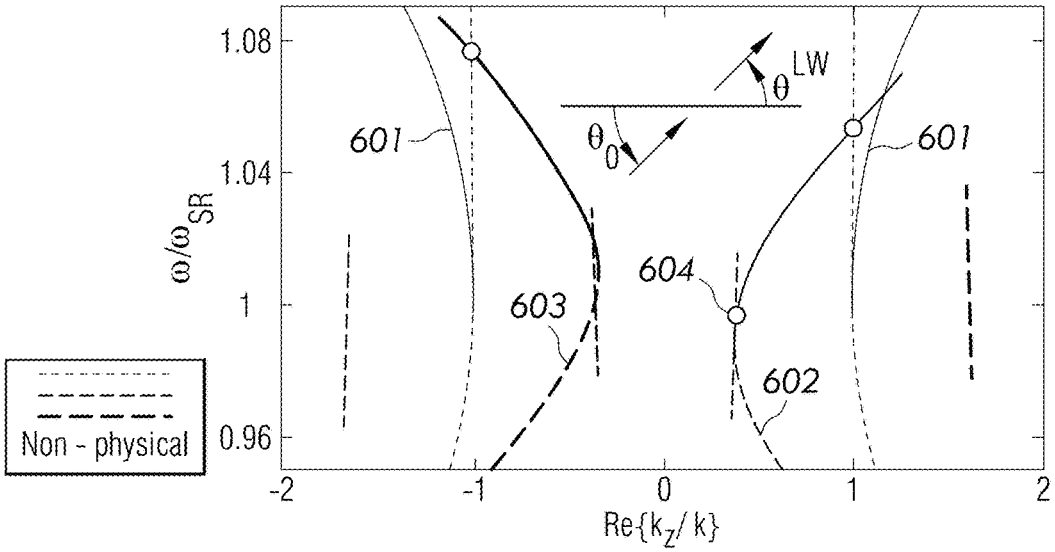
FIGS. 6A and 6B show the complex dispersion of the transverse wave-vector for the 0-th and 1-st order harmonics of the TM surface and leaky modes, respectively, supported by a surface with $L_0=\eta_0 Q/2\omega_{SR}$ and $C_0=2/\eta_0 Q\omega_{SR}$, where Q=10 is the surface quality factor, m=0.01, $\beta/k=0.637$ and $\Omega/\omega_{SR}=0.01$, and $\eta_0$ is the free-space impedance in accordance with an embodiment of the present invention.
Figure 6B:
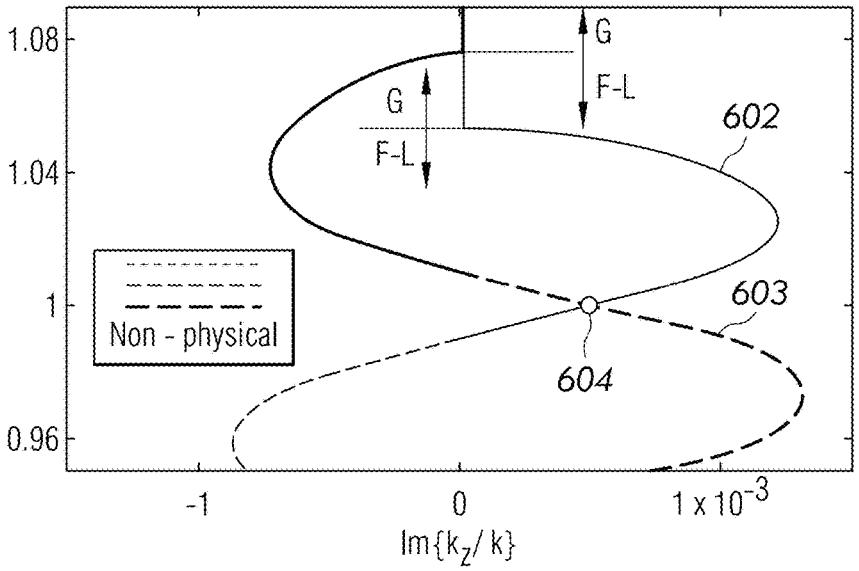

FIGS. 6A and 6B show the complex dispersion of the transverse wave-vector for the 0-th and 1-st order harmonics of the TM surface and leaky modes, respectively, supported by a surface with $L_0=\eta_0 Q/2\omega_{SR}$ and $C_0=2/\eta_0 Q\omega_{SR}$, where Q=10 is the surface quality factor, m=0.01, $\beta/k=0.637$ and $\Omega/\omega_s=0.01$, and $\eta_0$ is the free-space impedance in accordance with an embodiment of the present invention. The dispersion was derived by calculating the complex $k_z$ roots of Eq. (3) with $H_0=0$. Referring to FIGS. 6A-6B, the continuous (dotted) lines refer to the dispersion of physical (non-physical) modes, which can be significantly (weakly) excited by physical sources. Physical modes include guided (G) and leaky-forward (L-F) with $v_g v_p>0$. As illustrated in FIGS. 6A-6B, curves 601 correspond to TM modes on unmodulated surface. Curves 602, 603 correspond to a spatiotemporally modulated surface with $\beta/k=0.637$, $\Omega/\omega_{SR}=0.01$, m=0.01. The dashed lines in curves 601, 602, 603 represent the light cone for the n=0, n=1 and n=−1 harmonics, respectively. Referring to FIG. 6B, FIG. 6B illustrates the imaginary part of the mode wavenumber. Point 604 indicates the operation point for the results in FIGS. 7A-7C (discussed further below).

Without modulation, the surface dispersion is real and symmetric, and limited to the range $\omega>\omega_{SR}$, since TM modes are supported by inductive surfaces. These modes are guided, and cannot couple to free-space radiation. Spatial modulation allows coupling surface modes to radiation through higher-order harmonics, generating the EIT transparency window, but still preserving the dispersion symmetry. In this scenario, the dispersion diagram consists of an infinite set of propagation branches in both directions, shifted by $\beta$ with respect to each other.

The dispersion symmetry is lifted, and reciprocity is prevented, when a temporal gradient is added, which shifts vertically the n-th Floquet harmonic by $n\Omega$. Then, the cut-off frequency of the leaky harmonics, which are responsible for coupling to the radiation continuum, is different by $2\Omega$ for opposite propagation directions, as seen in FIGS. 6A-6B (lines 602 and 603). Consequently, with proper design, it is possible to excite the supported leaky mode, and achieve a transparency window from one direction, but not from its complementary.

For example, at frequency $\omega=\omega_{SR}$ one physical solution exists at $k_z/k=0.3949+5.5\times10^{-4}i$ (point 604 in FIGS. 6A and 6B), corresponding to a highly directive leaky mode, radiating towards $\theta^{LW}=\cos^{-1}(0.3949)=66.74°$. Therefore, an incident wave at $\theta_0=\theta^{LW}(\pi-\theta_0)$ would couple (poorly couple) with this mode, see inset of FIG. 6A, and Eq. (4) yields full-transmission (high-isolation). This is a direct evidence of strong nonreciprocity and isolation.

The incidence angles for which full-transmission occurs can be calculated in closed-form using $A_1=0$ or $A_{-1}=0$. In particular, assuming that $\omega\approx\omega_{SR}$, one obtains four solutions. Two are $$\cos\theta_0 \approx \pm\sqrt{1+[2(d\omega+\Omega)/\Delta\Omega]^2}-\beta/k \tag{5}$$

and the other two solutions are by replacing $-\Omega\mapsto\Omega$ and $-\beta\mapsto\beta$ in Eq. (5). Here, $\Delta\omega=\omega_{SR}/\Omega$ is the bandwidth of the unmodulated surface for normal incidence, and $d\omega=\omega-\omega_{SR}$ is the frequency detuning from the resonance of the unmodulated surface. Eq. (5) is valid if and only if (a) either the +1 or −1 diffraction order is evanescent within the visible angular spectrum $|k_z|<\omega/c$, i.e., $(\omega\pm\Omega)/c<|k_z\pm\beta|$, and (b) the surface impedance is inductive for that harmonic, i.e., $\omega<\omega_{SR}\mp\Omega$. The latter is equivalent to working above the cut-off frequencies of the physical leaky modes. Eq. (5) clearly shows that spatial modulation is enough to achieve angularly selective transmission, but cannot break time-reversal symmetry and the constraint in Eq. (1). The transparency window will necessarily occur at both $\theta_0$ and $\pi-\theta_0$. Angularly selective non-reciprocal transmission will only be obtained by realizing a transverse spatiotemporal gradient on the surface. For the set of parameters in FIGS. 6A-6B, Eq. (5) is satisfied only for $\theta_0=66.74°$, confirming the predictions based on the dispersion diagram in FIGS. 6A-6B. Interestingly, the full-transmission angle is independent of the modulation index m, which, as shown below, affects only the bandwidth of the transparency window.

Figure 7A:
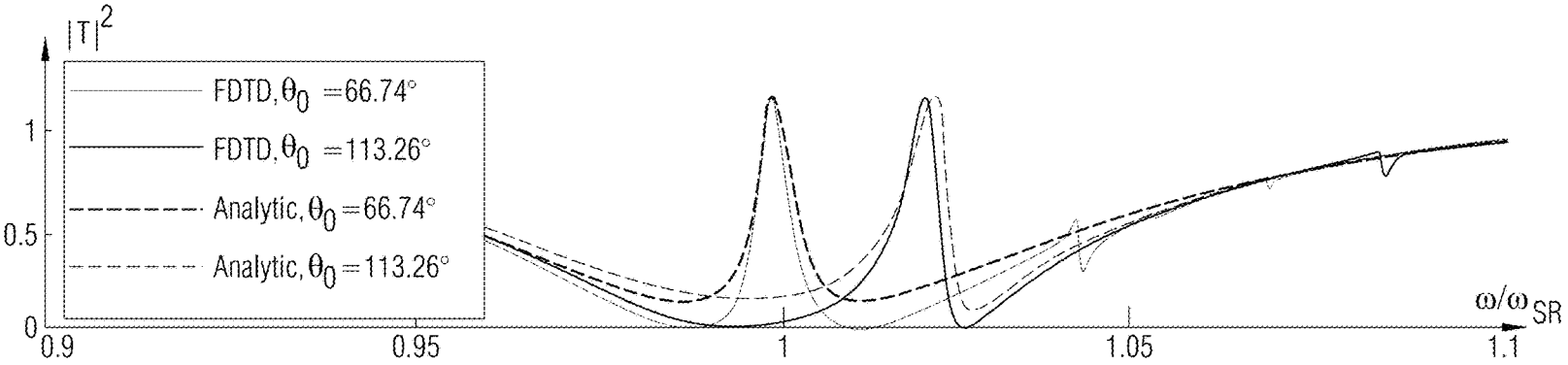
FIG. 7A illustrates the transmission vs. frequency for complementary incident waves at $\theta_0=66.74°$ and $180°\theta_0=113.26°$ in accordance with an embodiment of the present invention.
Figure 7B:
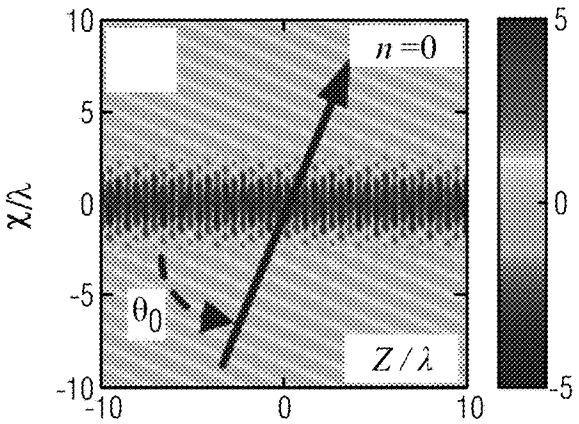
FIG. 7B illustrates the magnetic field profile for $\omega=\omega_{SR}$, and $\theta_0=66.74°$ when full transmission takes place in accordance with an embodiment of the present invention.
Figure 7C:
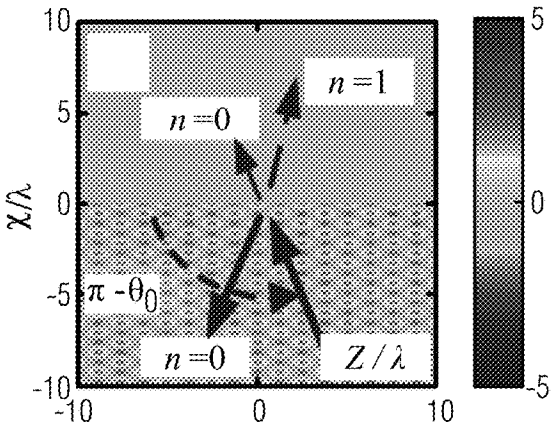
FIG. 7C illustrates the magnetic field profile for $\omega=\omega_{SR}$, and $\theta_0=66.74°$ for the excitation from $180°-\theta_0$ in accordance with an embodiment of the present invention.

FIGS. 7A-7C show the power transmission $|T|^2$ towards the zero-th diffraction order versus frequency for the incidence directions $\theta_0=66.74$ and $180°-\theta_0=113.26°$, and the corresponding magnetic field profiles at frequency $\omega_{SR}$.

In particular, FIG. 7A illustrates the transmission vs. frequency for complementary incident waves at $\theta_0=66.74°$ and $180°-\theta_0=113.26°$ in accordance with an embodiment of the present invention. The response was calculated by Finite-Difference Time-Domain (FDTD) and analytically, where the parameters $\Omega/\omega_{SR}=0.01$, m=0.05, $\beta/k=0.637$. FIG. 7B illustrates the magnetic field profile for $\omega=\omega_{SR}$ and $\theta_0=66.74°$ when full transmission takes place in accordance with an embodiment of the present invention. The reactive energy near the surface is large due to the enforced excitation of a weakly radiating leaky mode. No other propagating diffraction order is excited. FIG. 7C illustrates the magnetic field profile for $\omega=\omega_{SR}$ and $\theta_0=66.74°$ for the excitation from $180°-\theta_0$ in accordance with an embodiment of the present invention. No leaky mode is excited and the surface is practically opaque. The n=1 harmonic is weakly excited at a different frequency than the incident wave.

Referring to FIGS. 7A-7C, the transmission was calculated analytically through Eq. (4) and numerically using FDTD simulations. The field profiles were derived through FDTD simulations. The same parameters were used as in FIGS. 6A-6B, except for the modulation index which is m=0.05. Such an increase in m only reduces the EIT-like resonance Q-factor, thereby reducing the FDTD simulation time.

For incidence at $\theta_0=66.74°$, the transmission peaks at $\omega=\omega_{SR}$, consistent with the existence of a leaky mode at point 604 in FIGS. 6A-6B. However, for incidence at $180°-\theta_0=113.26°$, the transparency window is blue-shifted $\omega=1.02\omega_{SR}$, due to the blue-shift of the leaky mode propagating along the −z direction in FIGS. 6A-6B. The field profiles in FIGS. 7B and 7C verify that power is almost completely transmitted (reflected) for incidence from $\theta_0=66.74°$ ($180°-\theta_0=113.26$). The additional higher-order resonances in the FDTD simulation are the result of high-order modulation harmonics, due to the fact that the impedance operator involves the inverse of the harmonically-modulated capacitance. Although for m<<1, the higher-order harmonics are very small and can be neglected in the analytical treatment since they have a minor effect in the FDTD simulations.

The strong reactive fields in FIG. 7B close to the surface reveal the excitation of a strong resonance, which corresponds to the fundamental Floquet harmonic of the leaky mode in FIGS. 6A-6B. Its amplitude can be calculated as $H_1^r=(\eta_0/Z_{e_1})(k_x/k)H_0/m$, showing that, for $m<<1$, it can become much stronger than the incident-field amplitude $H_0$. However, in the case $180°-\theta_0=113.26°$, the reactive fields are very weak, since the coupling between the incident wave and the leaky mode is negligible. In such case, the impinging energy experiences specular reflection, except for a weak n=1 diffraction order at frequency $\omega=\omega_{SR}+\Omega$ and direction $\theta_1=\cos^{-1}(k_z^1/k_1)=76.1°$ with respect to $+\hat{z}$.

The anomalous EIT-like dispersion is a consequence of the interplay between wide resonance of the uniform metasurface and the much narrower resonance associated with the leaky mode produced by the modulation. For a specified $\theta_0$, the EIT-resonance bandwidth and Q-factor are approximately $$\delta\omega=m^2Q\omega_{SR}/4\sin\theta_0\rightarrow Q_{FT}=4\sin\theta_0/m^2Q, \quad (6)$$

predicting a vanishing bandwidth for infinitely small modulation index. For weak modulation, the lifetime of the surface leaky mode increases, and becomes infinite as $m\rightarrow 0$ (bound mode), when no coupling to free-space exists, opening the possibility to induce a non-reciprocal embedded scattering eigenstate on the surface. Finite Ohmic loss in practice yields a lower bound on $\delta\omega$, derived as min $\delta\omega=(\sqrt{2}-1)\Delta\omega R_0/\eta_0$, where $R_0$ is the distributed surface resistance. For moderate losses, the results presented herein still hold. The high-Q leaky resonance allows drastic relaxation of the requirements regarding the temporal modulation frequency required to achieve significant isolation. The frequency separation of full-transmission peaks for opposite propagation directions is $\overline{\omega}\approx\Omega+\Delta\omega\sqrt{\Omega/\omega_{SR}}$. For isolation between $\theta_0$ and $\pi-\theta_0$, $\overline{\omega}<\delta\omega$ is required. Therefore, unexpectedly, for a given $\Omega$, a weaker m leads to higher isolation, within the low-loss approximation. Eq. (6) also suggests that a lower Q-factor for the surface provides a larger resonance $Q_{FT}$. This is because a lower surface Q implies less sensitivity to the modulation, ensuring less energy leakage for a given m. Furthermore, the angular bandwidth also decreases as m increases, following a similar square power law.

Figure 8A:
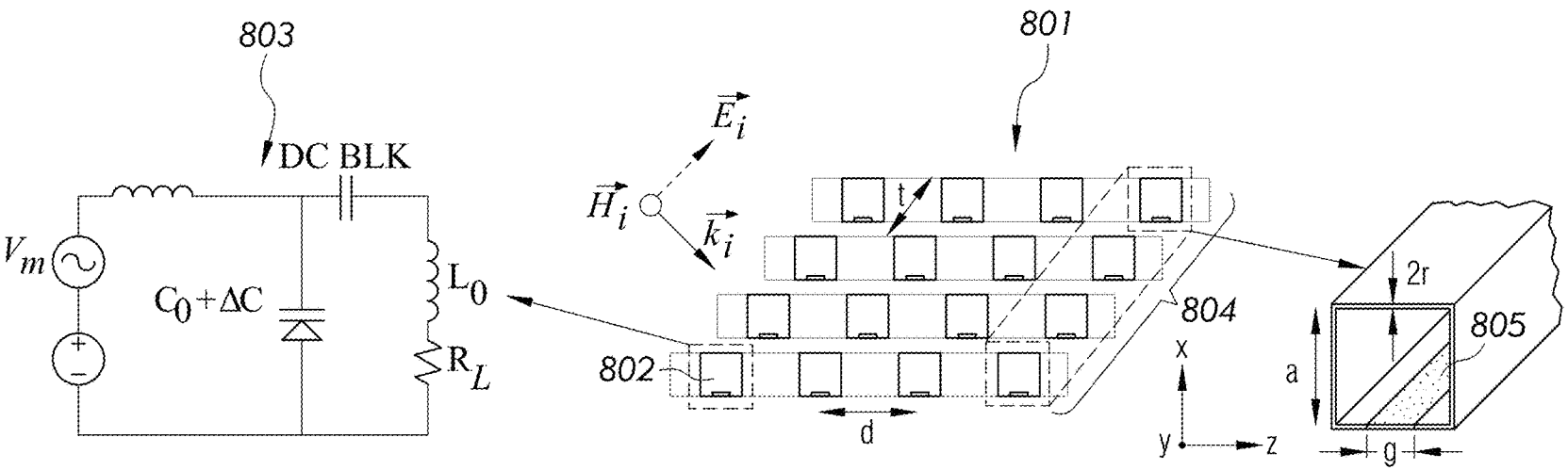
FIG. 8A illustrates an implementation of the surface impedance operator in Eq. (2) involving a two-dimensional array of split ring resonators (SRR) loaded with variable capacitors in accordance with an embodiment of the present invention.

As discussed above, the principles of the present invention provide a resonant metasurface characterized by transverse spatiotemporal gradients, where the spatiotemporal gradients include periodically modulated impedances thereby causing a non-reciprocal transmission response. A possible implementation of the metasurface involves a two-dimensional array 801 of split ring resonators (SRR) 802 loaded with variable capacitors as shown in FIG. 8A in accordance with an embodiment of the present invention. In one embodiment, the variable capacitors are implemented by filling gaps 805 (discussed further below) in a row 804 (discussed further below) of split-ring resonators 802 with time-modulated dielectric material. In another embodiment, the variable capacitors are implemented by varying capacitance diodes (varactors).

Referring to FIG. 8A, the left inset illustrates a lumped circuit model 803 for each of the split ring resonators 802. $L_0$, $R_L$ are the equivalent inductance and radiation/Ohmic resistance of a single loop, respectively. The right inset of FIG. 8A illustrates a zoom on a single loop of a row 804 of the array 801 of split ring resonators 802 as implemented in the finite-element simulation. The gap 805 in the row 804 is filled with a time-varying dielectric. In one embodiment, the gap may be filled with time-modulated capacitors. The side length, gap size and metal thickness of each of the SRRs 802 were selected as $\alpha=\lambda_0/15$, $g=0.0046\lambda_0$ and $r=0.01\lambda_0$, respectively, with $\lambda_0$ the resonance wavelength. Such parameters are based on the resonance wavelength since the side length, gap size, gap loading and the metal thickness of each of the SRRs 802 are designed to resonate at a desired resonance frequency. The modulation periodicity is $D=2\pi/\beta$, and the lattice periodicity is $d=D/N$, with N=10.

The structure described above was analyzed via full-wave finite-element simulations, with variable capacitors implemented by filling the gaps of the n-th row of the array 801 of SRRs 802 with time-modulated dielectric material $\grave{o}_r=\grave{o}_r^0[1+m\cos(\Omega t-\beta nd)]$, where d is the SRR periodicity. The modulation parameters are $\beta/k=0.793$, m=0.1 and $\Omega=0.02\omega_{SR}$. In order to relax the computational requirements of a full three-dimensional simulation, a distance between SRRs 802 along the y-direction was assumed to be $t<d<<\lambda_0$, and the 1D arrays were replaced with an equivalent two-dimensional SRR 802, as in FIG. 8A. In one embodiment, the particles are lossy, made of copper.

Figure 8B:
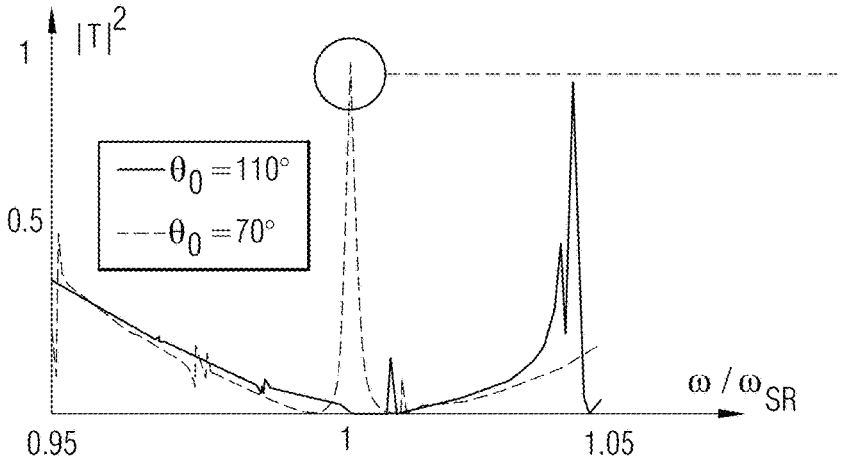
FIG. 8B illustrates the transmission at two complementary angles in accordance with an embodiment of the present invention.

FIG. 8B illustrates the transmission at two complementary angles in accordance with an embodiment of the present invention. The power transmission is given in FIG. 8B and its peaks are about 85-90% due to Ohmic loss. The non-reciprocal EIT-like response of the structure is evident. From FIG. 8B, the surface bandwidth is estimated as $\Delta\omega\approx 0.2\omega_{SR}$, implying $Q\approx 5$. Moreover, from FIG. 8B, $\delta\omega\approx 0.002\omega_{SR}$, which, when substituted into Eq. (6), yields an effective modulation index $m_{eff}\approx 0.038$. It is noted that $m_{eff}<m$ due to the discrete nature of the surface and additional parasitic capacitances, making $\delta\omega$ smaller than what would ideally be expected. The additional transmission resonances are due to higher-order modulation harmonics.

Figure 8C:
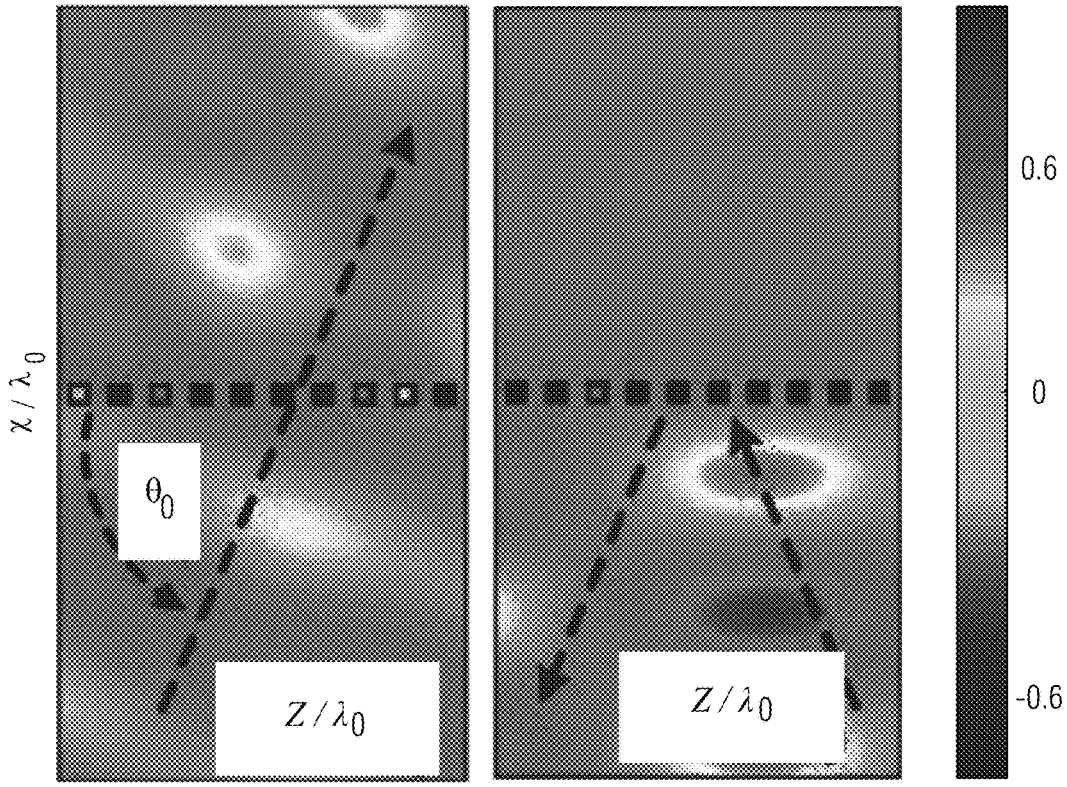
FIG. 8C illustrates the magnetic field at $\omega/\omega_{SR}\approx 1$ in accordance with an embodiment of the present invention.

FIG. 8C illustrates the magnetic field at $\omega/\omega_{SR}\approx 1$ in accordance with an embodiment of the present invention. Referring to FIG. 8C, almost full transmission (high isolation) is obtained at $\theta_0=70°$ ($\theta_0=110°$). The left panel of FIG. 8C shows the magnetic field distribution at the maximum-transmission frequency for an incidence angle of 70°, showing large transmission and almost zero reflection. The right panel of FIG. 8C corresponds to the complementary incident angle 110°, for which transmission is very small. The proposed RF structure in FIG. 8A may be practically realized using split ring resonators loaded by varactors, which work well up to the GHz range and can provide a wide range of modulation indices. In acoustics, modulation can be achieved through piezo-electric components, and in IR or optics, the modulation can be imparted via carrier injection, acousto-optical effects, or parametric modulation of non-linear media through strong laser pulses.

Hence, as discussed above, the concept of graded metasurfaces was extended by adding transverse temporal modulation to the electronic properties of surface impedance. It was shown that spatio-temporal modulation can overcome geometrical symmetry constraints of ultrathin surfaces, yielding non-reciprocal, angularly selective, full transmission through an ultrathin impedance surface. While the simple periodic space-time gradients were focused in the proof of concept scenario, this concept can be readily extended and applied to more sophisticated surfaces with impedance gradients that enable further control of light. The proposed concept of space-time gratings can also be used to enhance control over near-fields, and to create non-reciprocal radiation, opening new venues for efficient source-field manipulation.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

The invention claimed is:

1. A non-reciprocal device, comprising:

a transmission line comprising a plurality of antenna aperture slots, wherein said transmission line is periodically loaded with voltage dependent circuit elements, wherein said plurality of antenna aperture slots function as an antenna coupled to said transmission line;

wherein a modulation signal propagates along said transmission line and modulates said antenna in space and time by varying said voltage dependent circuit elements thereby yielding a non-reciprocal radiation response.

2. The non-reciprocal device as recited in claim 1, wherein said transmission line comprises a top plane and a bottom plane, wherein said top plane comprises said plurality of antenna aperture slots, wherein said bottom plane comprises said voltage dependent circuit elements located right below corresponding aperture slots to control said propagation phase.

3. The non-reciprocal device as recited in claim 2 further comprising:

a diplexer connected to said transmission line, wherein said diplexer combines radio frequency and modulation signals.

4. The non-reciprocal device as recited claim 3, wherein said diplexer is connected to said transmission line via a bias tee to superimpose a direct voltage bias.

5. The non-reciprocal device as recited in claim 2, wherein radiation patterns in transmit and receive modes of said antenna are asymmetric.

6. The non-reciprocal device as recited in claim 2, wherein said transmission line comprises a coplanar transmission line.

7. The non-reciprocal device as recited in claim 2, wherein said transmission line comprises a composite right-handed/left-handed transmission line.

8. A non-reciprocal device, comprising:

a resonant metasurface characterized by transverse spatiotemporal gradients traveling along a surface, wherein said spatiotemporal gradients comprise periodically modulated impedances in space and time thereby causing a non-reciprocal transmission response.

9. The non-reciprocal device as recited in claim 8, wherein said metasurface comprises an array of split-ring resonators loaded with voltage dependent circuit elements.

10. The non-reciprocal device as recited in claim 9, wherein said voltage dependent circuit elements are implemented as variable capacitors filling gaps in a row of split-ring resonators.

11. The non-reciprocal device as recited in claim 9, wherein said voltage dependent circuit elements are implemented by varying capacitance diodes.

12. The non-reciprocal device as recited in claim 9, wherein a length, a gap size, gap loading and a metal thickness of each split-ring resonator in said array of split-ring resonators are designed to resonate at a desired resonance frequency.

* * * * *